US008960318B2

(12) United States Patent
Munroe

(10) Patent No.: US 8,960,318 B2
(45) Date of Patent: Feb. 24, 2015

(54) FIRE SUPPRESSION NOZZLE

(76) Inventor: David B. Munroe, East Greenwich, RI (US)

( * ) Notice: Subject to any disclaimer, the term of this patent is extended or adjusted under 35 U.S.C. 154(b) by 203 days.

(21) Appl. No.: 13/190,092

(22) Filed: Jul. 25, 2011

(65) Prior Publication Data

US 2012/0018176 A1 Jan. 26, 2012

Related U.S. Application Data

(60) Provisional application No. 61/367,697, filed on Jul. 26, 2010.

(51) Int. Cl.
*A62C 35/00* (2006.01)
*A62C 31/12* (2006.01)

(52) U.S. Cl.
CPC ..... *A62C 31/12* (2013.01)
USPC ..... 169/14; 239/558

(58) Field of Classification Search
CPC ..... B05B 1/005; B05B 1/02; B05B 1/04; B05B 1/06; A62C 3/002; A62C 5/00; A62C 5/002; A62C 5/02; A62C 35/58
USPC ..... 239/461, 486, 501, 589, 601, 548, 558, 239/559; 169/14, 16
See application file for complete search history.

(56) References Cited

U.S. PATENT DOCUMENTS

| | | | | | |
|---|---|---|---|---|---|
| 1,549,537 | A * | 8/1925 | Hansen | 239/501 |
| 3,092,333 | A * | 6/1963 | Gaiotto | 239/491 |
| 5,433,383 | A * | 7/1995 | Sundholm | 239/383 |
| 5,642,907 | A * | 7/1997 | Dole | 285/112 |
| 5,853,129 | A * | 12/1998 | Spitz | 239/456 |
| 6,155,351 | A * | 12/2000 | Breedlove et al. | 169/14 |
| 6,315,219 | B1 * | 11/2001 | Palestrant | 239/550 |
| 2004/0035953 | A1 * | 2/2004 | Nelson et al. | 239/501 |

* cited by examiner

*Primary Examiner* — Davis Hwu
(74) *Attorney, Agent, or Firm* — Locke Lord LLP; George N. Chaclas

(57) ABSTRACT

A fire extinguishing device for the uniform distribution of compressed air foam for fire suppression, connected to a piping network of a CAF system. Multiple nozzles of different types are connected to a single body, set at specific angles both horizontally and vertically. Each nozzle is selected to provide a set discharge spray angle and positioned in the body of the device to provide the proper distribution. The device body has a female thread at the inlet for connection to the CAF system in addition to female outlets at the discharge for connection of spray nozzles. The device may be used to create a 360° spray pattern or a 120° spray pattern depending on the application.

11 Claims, 8 Drawing Sheets

FIRE SUPPRESSION NOZZLE

CROSS-REFERENCE TO RELATED APPLICATION

This application claims priority to U.S. Provisional Patent Application No. 61/367,697 filed Jul. 26, 2010, which is incorporated herein by reference. This application also relates to U.S. Pat. No. 7,712,542 issued May 11, 2010, U.S. Provisional Patent Application No. 60/737,918, filed Nov. 18, 2005, and U.S. Provisional Patent Application No. 60/764,501 filed Feb. 1, 2006, each of which is incorporated herein by reference.

BACKGROUND OF THE INVENTION

1. Field of the Invention

The subject disclosure relates to systems for automatic fire suppression, and more particularly to an improved system for automatically delivering compressed air foam (CAF) to a hazard area via a fire extinguishing spray nozzle. The systems are also effective for delivering CAF, foam and like substances to cover and control fire in typically difficult to safely and properly access areas.

2. Background of the Related Art

For centuries, man has battled unwanted fires. As technology has developed, the fire fighting techniques have matured from the bucket brigade to highly specialized vehicles, systems and chemicals. However, in many instances such as off-shore drilling platforms, boats, bulldozers and the like, access to water distribution networks or access by firefighting vehicles is not available along with other technical challenges. When a fire is relatively small, use of portable fire extinguishers is common. Further, depending upon the source of the fire, water may not be an appropriate agent for suppression. As such, emergency vehicles and portable extinguishers often deliver foam, non-water solutions, water with chemical additives for additional suppression capability and the like.

Use of portable extinguishers from hand-held versions and larger cart-like versions have been widely used and well understood in the art. For example, U.S. Pat. Nos. 5,881,817 and 6,089,324 to Mahrt, each of which is incorporated herein by reference, disclose a portable fire suppression system using cold compressed air foam. The portable system includes a manifold with a mixing chamber for expanding and accelerating the foam through the manifold by injecting cold compressed air adjacent the manifold inlet and at a 68 degree angle relative to the flow direction.

Technology continues to evolve in the area of fire suppression. Exemplary techniques are illustrated in U.S. Pat. No. 6,328,225 to Crampton (the Crampton patent), U.S. Pat. No. 6,082,463 to Ponte, U.S. Pat. No. 5,441,113 to Pierce, and U.S. Pat. No. 3,441,086 to Barnes, each of which is incorporated herein by reference.

Further, advances in technology are often gained by study and use of hazardous or infectious materials such as carcinogens and active virus cultures. As a result of handling such highly toxic and/or dangerous substances, suppression systems are needed to cover and/or control such substances. Although effective suppressants have been developed, an improved system for delivering these suppressants is needed.

A particularly difficult suppressant to deliver is compressed air foam (CAF). CAF is a mix of a concentrate, air and/water that is generated in a mixing chamber and then distributed by a piping network to nozzles in the hazard area. Prior art systems use a nozzle that is an open type. The nozzles are spaced to provide a uniform distribution of CAF over the entire area. The protected area is required by standards to have a set rate of application of agent or CAF per square foot per minute, in order to ensure fire extinguishment. The quality of the foam is a very important aspect of the ability of the foam to extinguish fires and prevent reflash. Approval authorities have recognized the importance of CAF quality and hold manufactures of CAF systems to specific standards in this regard.

Present fixed spray nozzles have not been able to distribute CAF without destroying the foam quality. The prior art nozzles breakdown the expanded CAF yielding a more liquid state thereby reducing the fire fighting ability of the CAF. Further, prior art nozzles do not produce a uniform distribution with the area near the center of the nozzle being particularly difficult to cover with CAF. Still further, prior art nozzles also fail to deliver desired rate of flow of CAF while maintaining the desired CAF quality and/or spray pattern, if at all.

SUMMARY OF THE INVENTION

There are devices that have been designed to apply CAF to a fire from a single hose stream, however none exist that can apply CAF from a fixed spray nozzle without the destruction of the foam. For the distribution of CAF the device must be created in a manner that at least in part directs the CAF rather than just deflects the CAF. The subject technology discloses such a nozzle and systems for using said nozzle among other advantages as would be recognized by those of ordinary skill in the pertinent art.

In view of the above, there is a need for an improved fire suppression system which delivers high quality CAF that will cling to vertical surfaces to extinguish fires and prevent reflash. An improved fire suppression system will also desirably provide an even and predictable spray pattern.

In another embodiment, the system is used to cover and control one or more biohazards in an environment such as a laboratory.

In another embodiment, the system is design to vigorously generate CAF for release while being a simple and efficient design.

The subject technology provides a fire extinguishing CAF spray device capable of effectively extinguishing fires using compressed air foam without the destruction of the foam quality, while distributing a uniform rate of application over the area of coverage.

The subject technology also provides a fire extinguishing CAF spray device capable of being easily manufactured.

In one embodiment, the subject technology is directed to a fire extinguishing CAF spray device connected to a vertical pipeline, the spray device including a nozzle body with one inlet connection of female thread in fluid communication with a chamber with four or more outlets connections of female thread of specific bore and angle. Open Spray nozzles insert into the outlets. Each nozzle is of a specific bore and provides a deflector of a set angle. By virtue of the nozzle selection, the CAF is guided gently into a desirable broadcast pattern.

It should be appreciated that the present invention can be implemented and utilized in numerous ways, including without limitation as a process, an apparatus, a system, a device, and a method for applications now known and later developed. These and other unique features of the system disclosed herein will become more readily apparent from the following description and the accompanying drawings.

BRIEF DESCRIPTION OF THE DRAWINGS

So that those having ordinary skill in the art to which the disclosed system appertains will more readily understand how to make and use the same, reference may be had to the accompanying drawings.

DETAILED DESCRIPTION OF PREFERRED EMBODIMENTS

The present invention overcomes many of the prior art problems associated with distributing compressed air foam (CAF) and the like for fire suppression and other applications. The advantages, and other features of the technology disclosed herein, will become more readily apparent to those having ordinary skill in the art from the following detailed description of certain preferred embodiments taken in conjunction with the drawings which set forth representative embodiments of the present invention.

The illustrated embodiments can be understood as providing exemplary features of varying detail of certain embodiments, and therefore, unless otherwise specified, features, components, modules, elements, and/or aspects of the illustrations can be otherwise combined, interconnected, sequenced, separated, interchanged, positioned, and/or rearranged without materially departing from the disclosed systems or methods. Additionally, the shapes and sizes of components are illustrative and exemplary, and unless otherwise specified, can be altered without materially affecting or limiting the disclosed technology. All relative descriptions herein such as left, right, up, and down are with reference to the Figures, and not meant in a limiting sense.

Figure 1:
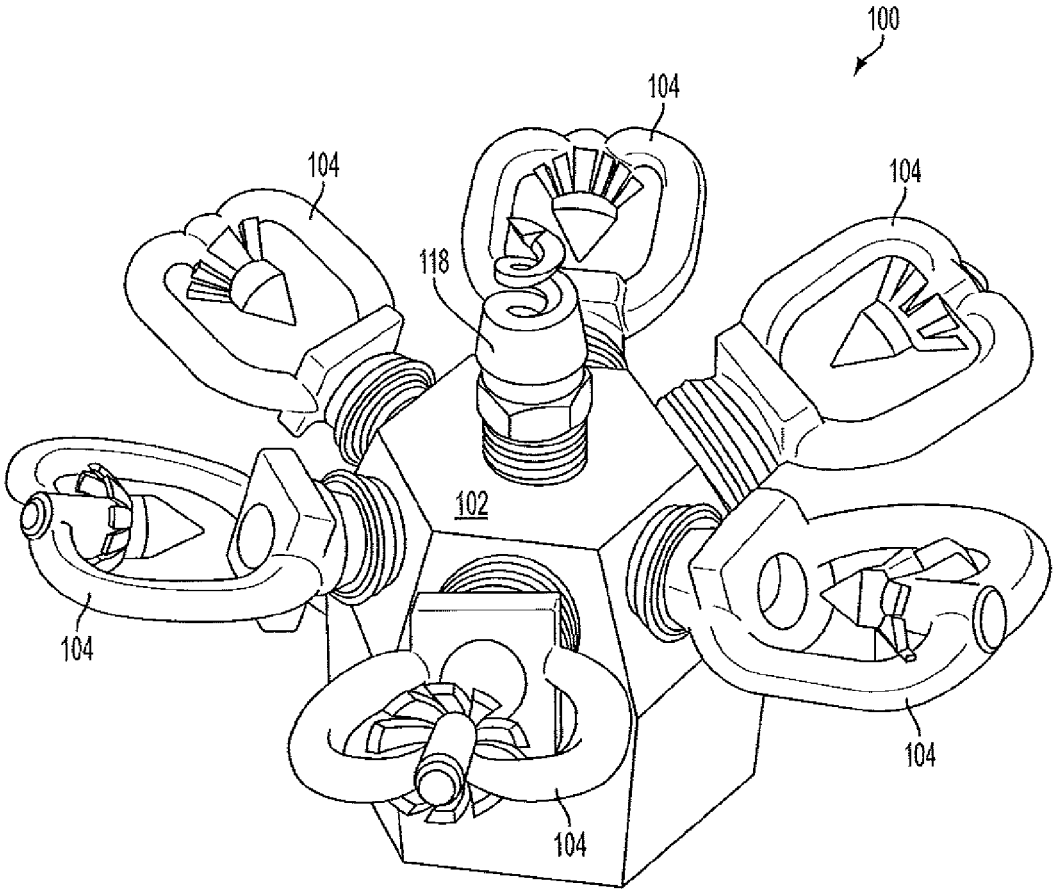
FIG. 1 illustrates a perspective view of a fire suppression nozzle assembly particularly well-suited for distributing compressed air foam (CAF) in accordance with the subject technology.

Now referring to FIG. 1, a perspective view of a fire suppression nozzle assembly 100 particularly well-suited for distributing compressed air foam (CAF) in accordance with the subject technology is shown. The fire suppression nozzle assembly 100 may be utilized in a wide variety of applications such as those shown and discussed in U.S. Pat. No. 7,712,542. The fire suppression nozzle assembly 100 includes a manifold body 102 for distributing a flow of CAF to a plurality of angled nozzles 104 and a central nozzle 118. The angled nozzles 104 are arranged to create a large circular spray pattern while the central nozzle 118 creates a smaller centralized circular spray pattern to yield CAF dispersed evenly in the entire spray pattern.

In the design of fire suppression systems, different spray patterns are often required to spray onto, around and under objects that may be protected or present an obstruction to the spray. By increasing or decreasing the number of nozzles 104 and/or by changing the orientation of the body 100, different spray patterns may be created.

Figure 2:
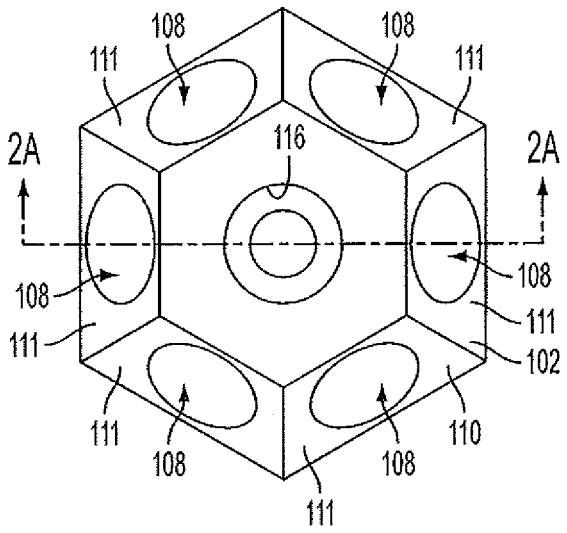
FIG. 2 illustrates a top view of a manifold body for a fire suppression nozzle assembly in accordance with the subject technology.
Figure 2A:
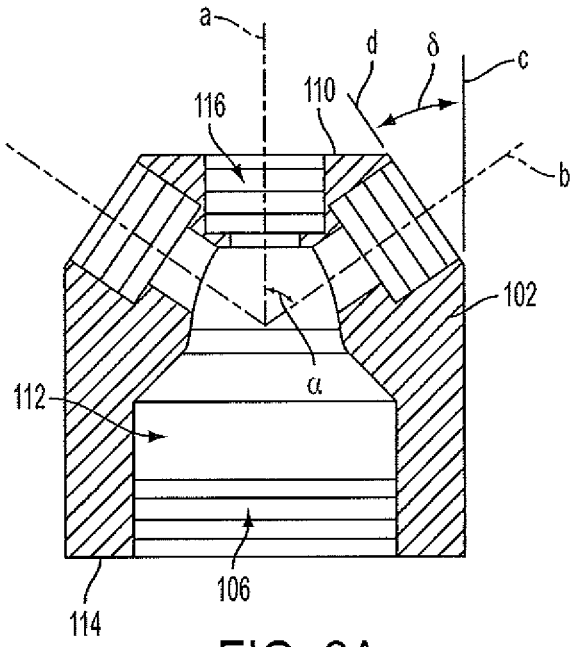
FIG. 2A illustrates a cross-sectional view of the manifold body of FIG. 2 taken along line 2A-2A.

Referring now to FIGS. 2 and 2A, top and cross-sectional views of the manifold body 102 for the fire suppression nozzle assembly 100 are shown. The manifold body 102 defines a central inlet 106 at a proximal end 114. The central inlet 106 forms a central passageway 112 along a central axis a that provides fluid to a plurality of angled outlets 108 in a distal end 110. The changes in bore size of the central inlet 106 are made with sweeping smooth surfaces to minimize and avoid destruction of CAF quality.

The angled outlets 108 are arranged along an acute axis b at an angle $\alpha$ with respect to the central axis a. Typical angles $\alpha$ are between 30 and 60 degrees. In one embodiment, the angle $\alpha$ is 45 degrees. The manifold body 102 also forms an axis c parallel to the axis a. The angled outlets 108 terminate in planar surfaces that contain an axis d. The angle $\delta$ formed between axis c and axis d helps determine the resulting spray pattern. Typical angles $\delta$ are between 10 and 50 degrees. In one embodiment, the angle $\delta$ is 35 degrees. In another embodiment, the angle $\delta$ is 30 degrees.

The manifold body 102 also forms a central outlet 116 axially aligned with the central inlet 106 along axis a and in fluid communication with the central inlet 106. In the embodiment shown, the six angled outlets 108 are arranged in a circular or hexagonal pattern around the central outlet 116 as best seen FIG. 2. The angled outlets 108 are also evenly distributed about the central nozzle 118. In an alternative embodiment, the angled outlets 108 could be unevenly clustered, a different number, or arranged in a different pattern such as an octagon, septagon, pentagon, square, a rectangle, a trapezoid, a triangle and the like to form a desired spray pattern.

Figure 3:
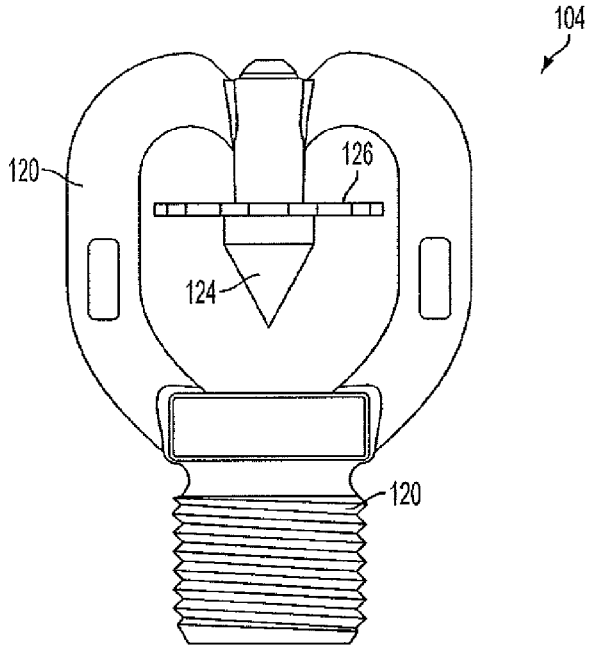
FIG. 3 illustrates a perspective view of an open nozzle for a fire suppression nozzle assembly in accordance with the subject technology.
Figure 3A:
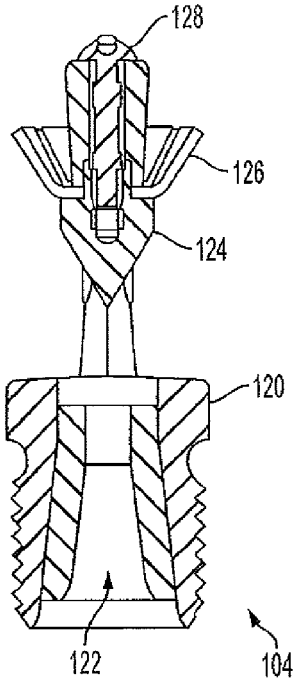
FIG. 3A illustrates a cross-sectional view of the open nozzle of FIG. 3.

Referring now to FIGS. 3 and 3A, perspective and cross-sectional views of an open spray nozzle 104 for a fire suppression nozzle assembly 100 in accordance with the subject technology is shown. These angled nozzles 104 provide directional spray and can be sized to meet various design requirements. The open spray nozzle 104 has a threaded frame 120 that defines a central bore 122. Fluid enters and exits the central bore 122 to impinge against a splitter 124 and defector 126, which are held onto the frame 120 by a fastener 128. The configuration of the angled nozzles 104 can be modified to create a desired solid uniform cone spray.

Figure 4:
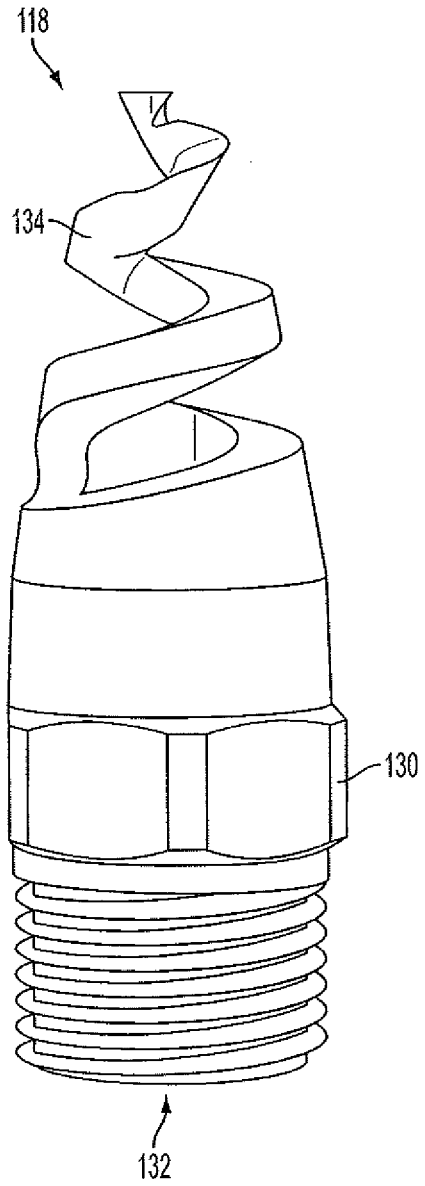
FIG. 4 illustrates a perspective view of a spiral nozzle for a fire suppression nozzle assembly in accordance with the subject technology.

Referring now to FIG. 4, a perspective view of a spiral configuration central nozzle 118 for a fire suppression nozzle assembly 100 in accordance with the subject technology is shown. The central nozzle 118 also has a threaded frame 130 that defines a central bore 132. Fluid enters and exits the central bore 132 exit by flowing through a corkscrew end 134.

The central nozzle 118 can also be modified to create a desired solid cone shaped spray pattern with a round impact area.

Figure 5:
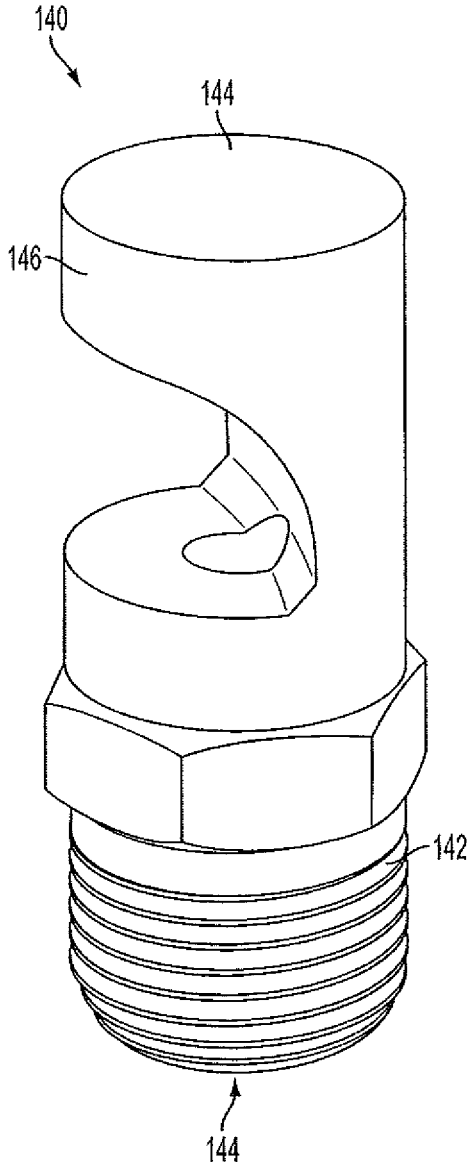
FIG. 5 illustrates a perspective view of a flat fan spray nozzle for a fire suppression nozzle assembly in accordance with the subject technology.

Referring now to FIG. 5, a perspective view of a flat fan spray nozzle 140 for a fire suppression nozzle assembly in accordance with the subject technology is shown. The flat fan spray nozzle 118 also has a threaded frame 142 that defines a central bore 134. Fluid enters and exits the central bore 142 to impinge upon a distal head portion 144. The distal head portion 144 has an arcuate surface 146 to create a wide angle flat fan spray pattern with uniform distributin and medium impact. The flat fan spray nozzle 140 can also be modified to create a desired spray pattern to yield an overall desired pattern once placed in a fire suppression nozzle assembly. As can be seen, various types, combinations, and arrangements of nozzles may be used on variously configured manifold bodies to create a desired spray pattern.

Figure 6:
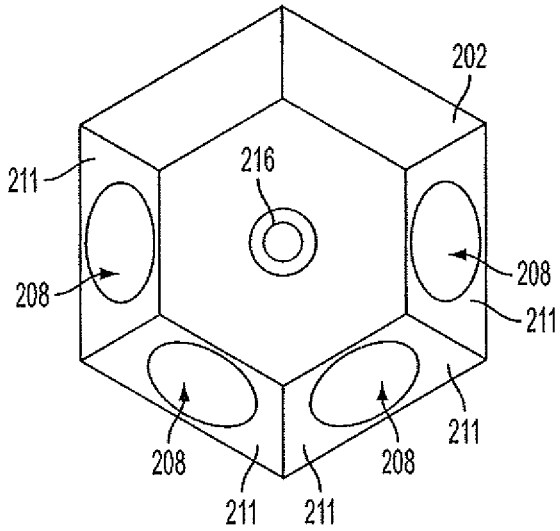
FIG. 6 illustrates a top view of another manifold body for a fire suppression nozzle assembly in accordance with the subject technology.
Figure 7A:
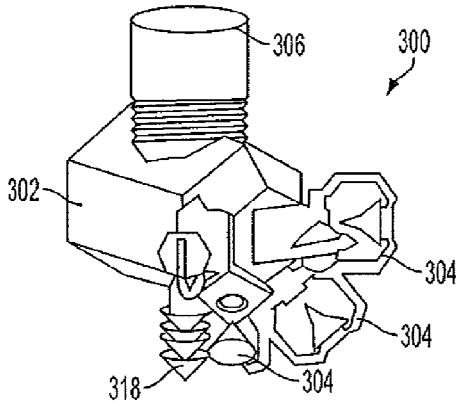
FIG. 7A illustrates a perspective view of still another fire suppression nozzle assembly particularly well-suited for distributing CAF in accordance with the subject technology.
Figure 7B:
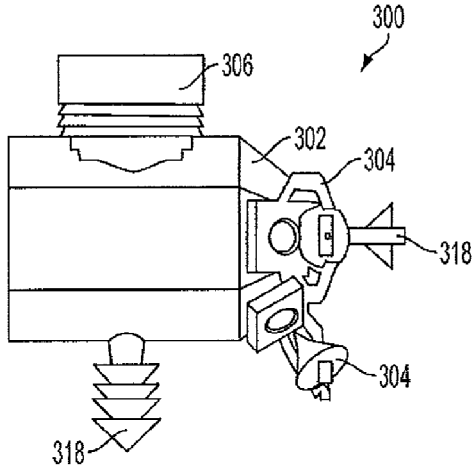
FIG. 7B illustrates a side view of the manifold body of FIG. 7A.
Figure 7C:
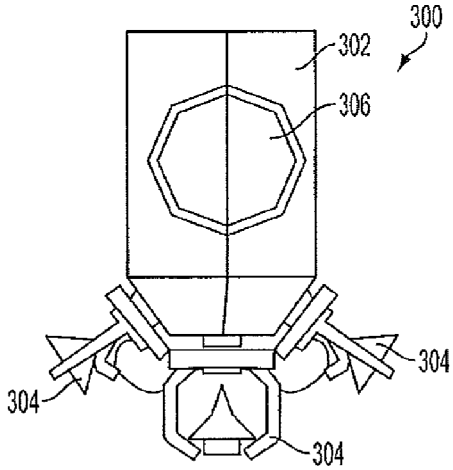
FIG. 7C illustrates a top view of the manifold body of FIG. 7A.
Figure 7D:
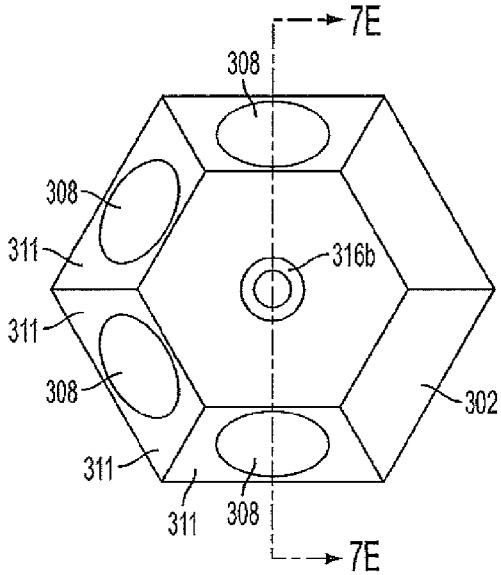
FIG. 7D illustrates an end view of the manifold body of FIG. 7A.
Figure 7E:
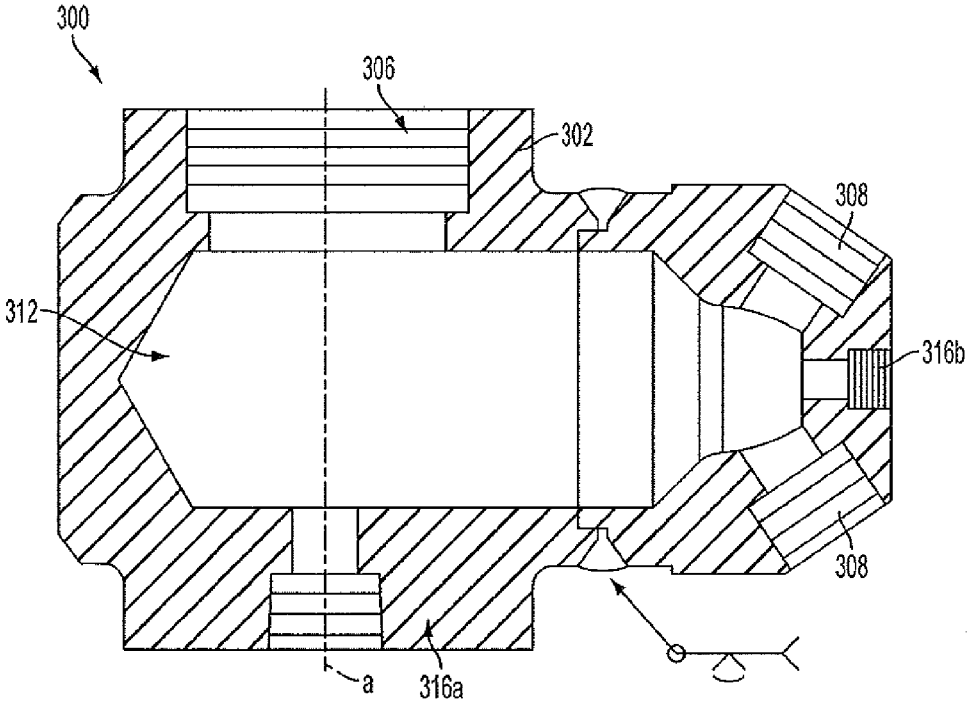
FIG. 7E illustrates a cross-sectional view of the manifold body of FIG. 7D taken along line 7E-7E.

Now referring to FIG. 6, a top view of another manifold body 202 for a fire suppression nozzle assembly in accordance with the subject technology is shown. As will be appreciated by those of ordinary skill in the pertinent art, the manifold body 202 utilizes similar principles to the manifold body 102 described above. Accordingly, like reference numerals preceded by the numeral "2" instead of the numeral "1", are used to indicate like elements. The primary difference of the manifold body 202 in comparison to the manifold body 102 is that only four angled outlets 208 are formed in the distal end 210. As a result, the spray pattern changes. It is envisioned that any arrangement and number of angled outlets 208 may be utilized.

Referring now to FIGS. 7A-7E, various views of still another fire suppression nozzle assembly 300 particularly well-suited for distributing CAF in accordance with the subject technology is shown. As will be appreciated by those of ordinary skill in the pertinent art, the nozzle assembly 300 utilizes similar principles to the nozzle assembly 100 described above. Accordingly, like reference numerals preceded by the numeral "3" instead of the numeral "1", are used to indicate like elements.

The nozzle assembly 300 includes a central inlet 306 that feeds a first central outlet 316*a* axially aligned with the central inlet 306. A sideways portion 330 extends substantially perpendicularly from the central inlet 306 and the first central outlet 316. The sideways portion has a plurality of angled outlets 308 in fluid communication with the central inlet and spaced about a second central outlet 316*b*, which is also in fluid communication with the central inlet 306. A plurality of open nozzles 304 couple to the plurality of angled outlets 308 for directing CAF. A spiral nozzle 318 couples to each of the first and second central outlets 316*a*, 316*b* for directing CAF. In another embodiment, the manifold body 302 includes a second sideways portion that minors the first sideways portion to yield a substantially rectangular 32×10 foot spray pattern. It is envisioned that any arrangement and number of sideways portions, angled outlets, and central outlets may be utilized to accomplish a desired spray pattern.

While the invention has been described with respect to preferred embodiments, those skilled in the art will readily appreciate that various changes and/or modifications can be made to the invention without departing from the spirit or scope of the invention. For example, aqueous film forming foam, halogen and the like may be delivered by systems in accordance with the subject technology as would be appreciated by those of ordinary skill in the pertinent art based upon review of the subject disclosure.

What is claimed is:

1. A fire suppression system for directing compressed air foam (CAF) comprising:

a storage of CAF concentrate, air and water;

a mixing chamber connected to the storage for receiving and mixing the CAF concentrate, the air and the water to create the CAF;

piping extending from the mixing chamber; and a nozzle assembly nozzle assembly for distributing the CAF including:

a) a manifold body defining:

i) a central inlet at a proximal end connected to the piping for receiving the CAF;

ii) a plurality of outlets in fluid communication with the central inlet and equally spaced about a distal end; and iii) a central outlet axially aligned with the central inlet and centrally aligned within the distal end, wherein a bore size of the central inlet reduces towards the plurality of outlets and the central outlet with sweeping smooth surfaces to minimize and avoid destruction of a quality of the CAF;

b) a plurality of open nozzles coupled to the plurality of outlets for directing CAF; and c) a spiral nozzle coupled to the central outlet for directing CAF.

2. A fire suppression system as recited in claim 1, wherein an angle between the central outlet and each of the plurality of outlets is 65 degrees.

3. A fire suppression system as recited in claim 1, wherein an angle between the central outlet and each of the plurality of outlets is 60 degrees.

4. A fire suppression system as recited in claim 1, wherein an angle between the central outlet and each of the plurality of outlets is 55 degrees.

5. A fire suppression system as recited in claim 1, wherein the distal end has a polygonal portion defining the plurality of outlets.

6. A fire suppression system as recited in claim 5, wherein the polygonal portion is hexagonal-shaped and includes six outlets.

7. A fire suppression nozzle assembly as recited in claim 1, wherein the spiral nozzle creates a solid cone shaped spray pattern of CAF and each of the plurality of open nozzle creates a directional spray pattern.

8. A fire suppression nozzle assembly as recited in claim 7, wherein the directional spray pattern of the open nozzles is directed radially outward from the nozzle assembly.

9. A fire suppression nozzle assembly for projecting and directing compressed air foam (CAF) comprising:

a) a manifold body defining:

i) a central inlet at a proximal end; and ii) a plurality of outlets in fluid communication with the central inlet and formed in a distal end, wherein a bore size of the central inlet reduces towards the plurality of outlets with sweeping smooth surfaces to minimize and avoid destruction of a quality of the CAF while maintaining energy in the CAF for projecting the CAF; and b) a plurality of open nozzles coupled to the plurality of outlets for projecting and directing the CAF in a predetermined spray pattern with uniform distribution, wherein the plurality of nozzles includes a plurality of open nozzles equally spaced about a spiral nozzle.

10. A fire suppression nozzle assembly as recited in claim 9, wherein an angle between the central outlet and at least one of the plurality of outlets is in a range between 20 and 75 degrees.

11. A fire suppression nozzle assembly as recited in claim 9, wherein the manifold body defines a central outlet axially aligned with the central inlet and centrally aligned and further comprising a nozzle coupled to the central outlet.

* * * * *